United States Patent [19]

Kawai et al.

[11] Patent Number: 4,929,804

[45] Date of Patent: May 29, 1990

[54] PUSH BUTTON SWITCH

[75] Inventors: Nobuyuki Kawai, Gunma; Mitsuhiro Nakamura, Tokyo, both of Japan

[73] Assignee: Toshiba Silicone Co., Ltd., Japan

[21] Appl. No.: 278,408

[22] Filed: Dec. 1, 1988

[30] Foreign Application Priority Data

Dec. 4, 1987 [JP] Japan ..... 62-306944

[51] Int. Cl.[5] ..... H01H 21/80; H01H 13/12; H01C 10/10

[52] U.S. Cl. ..... 200/5 A; 200/517; 200/553; 200/339; 338/114

[58] Field of Search ..... 200/1 R, 5 R, 5 A, 6 A, 200/511–517, 557, 315, 339; 178/18; 338/99, 114; 354/486

[56] References Cited

U.S. PATENT DOCUMENTS

| | | | |
|---|---|---|---|
| 3,728,509 | 4/1973 | Shimojo | 200/511 X |
| 3,860,771 | 1/1975 | Lynn et al. | 200/1 R X |
| 3,879,576 | 4/1975 | DuRocher et al. | 200/511 X |
| 4,324,472 | 4/1982 | Terada et al. | 200/511 X |
| 4,378,478 | 3/1983 | Deeg | 200/515 |
| 4,491,702 | 1/1985 | Kato | 200/5 A |
| 4,499,342 | 2/1985 | Nakayama | 200/5 A |
| 4,654,488 | 3/1987 | Westfall | 200/5 R |
| 4,687,200 | 8/1987 | Shirai | 200/339 X |
| 4,775,574 | 10/1988 | Fukushima et al. | 200/5 A |
| 4,794,366 | 12/1988 | Sakamoto | 338/114 |
| 4,818,827 | 4/1989 | Ipcinski et al. | 200/5 A |

*Primary Examiner*—J. R. Scott

*Attorney, Agent, or Firm*—Sughrue, Mion, Zinn, Macpeak & Seas

[57] ABSTRACT

A push button switch which may be used, for example, as a zooming switch in a video camera, having a uniform electrical resistance/applied pressure characteristic and which can be manufactured easily and at a low cost. The switch includes a conductive layer and a pressure-sensitive resistance element disposed between electrode patterns provided on a printed circuit board and an insulated push button. The conductive layer is coated with a pressure-sensitive conductive paste and the pressure-sensitive resistance element is fixed to the insulated push button at a opposed surface to the electrode patterns separated by a predetermined distance.

1 Claim, 1 Drawing Sheet

PUSH BUTTON SWITCH

BACKGROUND OF THE INVENTION

The present invention relates to a push button switch intended for use as a zooming switch in a camera such as a video camera, 8 mm camera, or the like. In such a switch, the resistance value of a pressure-sensitive resistance element contained in the push button switch is varied according to the depression pressure exerted on the push button. The rotational speed of a motor driving a zoom lens system, for instance, can thus be varied continuously with such a zooming switch.

FIG. 1 is a diagram showing a cross-sectional view of a conventional push button switch having a pressure-sensitive conductive rubber element 1 as a pressure-sensitive resistance element, an insulated push button 2, and a conductive layer 3. The pressure-sensitive conductive rubber element 1 is laminated through the conductive layer 3 to the insulated push button 2 as shown in FIG. 1. The pressure-sensitive conductive rubber element 1 is obtained by stamping a pressure-sensitive conductive rubber sheet so as to cut out the element 1 in the same shape as that of a pressing surface 2*a* of the push button 2.

Upon depressing the push button 2, the pressure-sensitive conductive rubber element 1 is pressed toward electrode patterns 14 and 15 formed on a substrate 4, as a result of which the electrodes 14 and 15 are electrically connected through the conductive layer 3. In this case, the resistance value of the conductive layer 3 varies in response to the pressure of the push button 2.

With such a push button switch as described above with reference to FIG. 1, the insulated push button 2 and the conductive layer 3 are molded together as a unitary member. Then, the pressure-sensitive conductive rubber element 1, which is stamped out in the desired shape from a pressure-sensitive conductive rubber sheet, is fixed to the conductive layer 3.

The conventional push button switch, however, is disadvantageous in that:

(i) the pressure-sensitive conductive rubber sheet is quite expensive;

(ii) the manufacturing process is troublesome because the pressure-sensitive conductive rubber element has to be fixed to the conductive layer after the molding of the insulated push button 2 and the conductive plate 3; and (iii) it is necessary to provide various kinds of sensitive conductive rubber elements having various thicknesses in advance in order to be able to change the characteristics of the switch, i.e., the relationship between the pressure applied to the switch and resistance thereof.

SUMMARY OF THE INVENTION

In view of the above, an object of the present invention is to provide a push button switch having electrical characteristics and a low manufacturing cost.

Another object of the invention is to provide a manufacturing method for a push button switch with which is easy to control the electrical characteristics of the switch and with which the switch can be easily assembled.

The present invention has been attained to solve the foregoing problems.

In accordance with the invention, there is provided a push button switch having a conductive layer and a pressure-sensitive resistance element disposed between electrode patterns provided on a printed circuit board and an insulated push button, the conductive layer is coated with a pressure-sensitive conductive paste and the pressure-sensitive resistance element is fixed to the insulated push button at an opposed surface to the electrode patterns separated by a predetermined distance.

The push button switch of the invention is formed by the following steps:

(1) A conductive rubber sheet coated with a pressure-sensitive conductive paste is stamped out to a desired shape by a pressing machine or, alternatively, a conductive rubber sheet stamped out to a desired shape by a pressing machine is coated with a pressure-sensitive conductive paste.

(2) The stamped conductive plate coated with the paste and an insulated push button made from insulating rubber are molded together into a unitary piece by heat curing.

(3) The push button is mounted above the electrode patterns.

When the push button is pushed, the pressure-sensitive resistance element contacts the electrode pattern. As the push button is further depressed, the resistance of the switch decreases gradually from infinity to several tens of ohms. Consequently, the switch is set to the conductive condition.

This variation of resistance value is utilized to control the rotational speed of a motor or the like.

DESCRIPTION OF THE PREFERRED EMBODIMENTS

Preferred embodiments of the present invention will be described hereinafter with reference to FIGS. 2 to 4.

Figure 1:
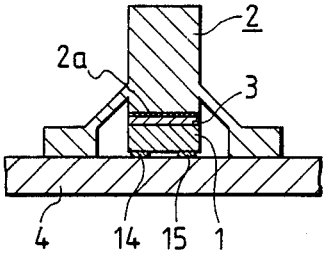
FIG. 1 PRIOR ART
FIG. 1 is a diagram showing a cross-sectional view of a conventional push button switch.
Figure 2:
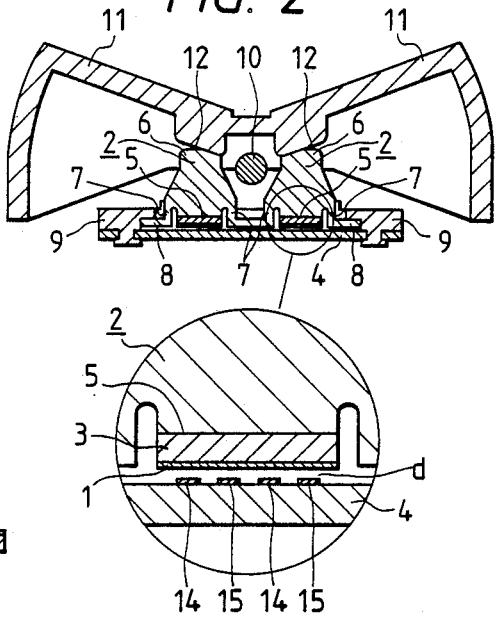
FIG. 2 is a diagram showing a cross-sectional view of a push button switch embodying the present invention.
Figure 3A:
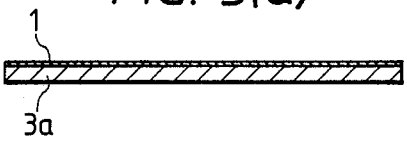
FIG. 3(*a*) to 3(*c*) are diagrams illustrating a manufacturing method for a push button according to the present invention.
Figure 3B:
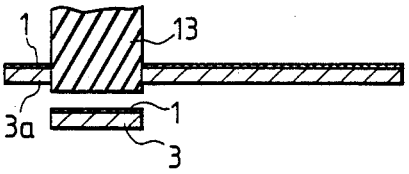
Figure 3C:
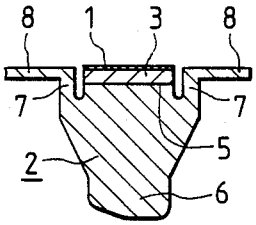

FIG. 2 is a diagram illustrating a cross-section of a seesaw-type push button switch which is to be used as a zooming switch in a video camera, an 8 mm camera, or the like.

A push button 2 made of insulating rubber is shaped to have a pair of protrusions connected to each other as shown in FIG. 2. A pressing button surface 5 of the push button 2 and a circular conductive layer 3 coated with a paste and acting as a pressure-sensitive resistance element are molded together as a unitary member by press curing under heat. Upper portions of the push button 2 serve as pressing button cover 11, whereas base surfaces of the push button 2 serve as pressing button surfaces 5.

A thin portion 7 is provided at the periphery of the pressing surface 5 so as to allow vertical movement of the button 2. Further, a flange portion 8 is provided at the periphery of the thin portion 7. The flange portion is fixed to a printed circuit board 4 in such manner that the flange 8 is sandwiched between a supporting member 9 and the printed circuit board 4. In the switch assembled as above, there is an air-gap (d) of 0.3 to 0.4 mm between the pressure-sensitive resistance element 1 and the electrode patterns 14 and 15 provided on the printed circuit board 4. The button cover 11 is movably supported on the printed circuit board 4 by a shaft 10. The button cover 11 is positioned in such a manner that the protrusions 12 oppose the projection portions 6.

Next, a manufacturing method for the push button 2 will be described with reference to FIGS. 3(*a*) to 3(*c*).

The method of the invention includes steps of:

(a) coating a conductive rubber sheet 3*a* having a thickness of 0.5 to 1.0 mm with a pressure-sensitive conductive paste, and subjecting the rubber sheet 3*a* to drying and solidifying to form the pressure-sensitive resistance element 1 having a thickness of several tens of microns;

(b) stamping out a piece having a desired shape (e.g. a circular member of 4 mm diameter) from the conductive rubber sheet 3*a* coated the pressure-sensitive resistance element 1 with a stamping machine 13;

(c) molding the push button 2, which is made from insulated rubber, and the conductive plate 3 together into a unitary member by press during under heat after positioning the conductive plate 3 on the pressing surface 5.

Steps (a) and (b) may be reversed. That is, the desired shape may be stamped out from the conductive rubber sheet to form the conductive plate 3, and then the conductive plate 3 is coated several tens of microns of the pressure-sensitive conductive paste to form the pressure-sensitive resistance element 1.

Figure 4:
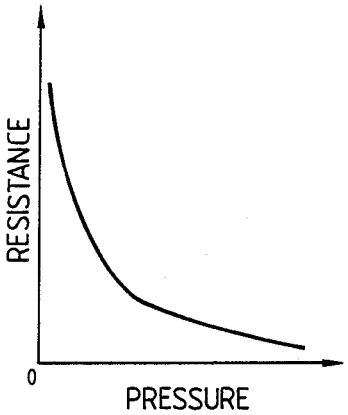
FIG. 4 is a diagram illustrating an electrical characteristic of a pressure-sensitive element.

In the above-described embodiment, the pressure-sensitive resistance element 1 has a nonlinear variation of resistance, as shown in FIG. 4. If through a linear variation of resistance is required, a substantially linear variation of the resistance value can be obtained by connecting a fixed resistor in parallel with the pressure-sensitive resistance element.

With the seesaw-type push button switch described above, when one side of the cover 11 is pressed, the resistance value is at first relatively large, causing the motor to rotate slowly in a positive direction. Accordingly, the focusing lens is moved in the positive direction. Thereafter, when the button is depressed more strongly, the resistance value decreases according to the increase in pressure so that the motor rotates at a higher speed. If the other side of the cover 11 is depressed, the motor rotates in the reverse direction. Due to the variation in resistance value, the rotational speed of the motor varies in accordance with the pressure.

While the invention has been described with reference to a seesaw-type push button switch used for a zooming switch, the switch is not limited thereto. That is, the invention can be used with a simple push button switch.

As described above, a conductive plate coated with a pressure-sensitive resistance element in paste form and a push button made from insulating rubber are molded together to form a unitary member. Consequently, it is possible to manufacture the switch with a simple process and to obtain inexpensive switches having uniform characteristics. Further, it is easy to control the thickness of the pressure-sensitive conductive element since the quantity of coated paste can be readily controlled, and thus the pressure-resistance characteristic is controlled.

Furthermore, if the pressure-sensitive resistance element is separated from the electrode patterns by a small air-gap, the switch can be prevented from operating abnormally because the insulating characteristics of the switch are maintained.

What is claimed is:

1. A push button switch having a resistance value varying in response to variations in a pressure applied thereto, said push button switch comprising:

a printed circuit board having electrode patterns;

a pressure-sensitive resistance element to be pressed against said electrode patterns, said pressure-sensitive resistance element comprising a conductive layer coated with a layer of solidified pressure-sensitive conductive paste and molded together by press curing under heat;

an insulated push button comprising a pressing surface at a base portion thereof, two projection portions at an upper portion of said insulated push button, and a flange portion fixed to said printed circuit board, said conductive layer of said pressure-sensitive resistance element being fixed to said pressing surface and being spaced from said electrode patterns by a predetermined gap, and said two projection portions being separated by a thin portion for allowing vertical movement of said insulated push button;

a button cover having two protrusions adjacent in one-to-one correspondence to said two projection portions, either of said protrusions exclusively pressing against one of said projection portions when said button cover is pressed by a user;

a shaft between said two projection portions for movably supporting said button cover on said printed circuit board, said button cover being movable in a seesawing motion; and a supporting member fixed to said printed circuit board such that said flange portion is fixedly sandwiched between said supporting member and said printed circuit board.

* * * * *

UNITED STATES PATENT AND TRADEMARK OFFICE

CERTIFICATE OF CORRECTION

PATENT NO. : 4,929,804

DATED : MAY 29, 1990

INVENTOR(S) : NOBUYUKI KAWAI ET AL.

It is certified that error appears in the above-identified patent and that said Letters Patent is hereby corrected as shown below:

On the title page, item [73]:

Please change the assignees from "Toshiba Silicone Co., Ltd." to --Toshiba Silicone Co., Ltd. and SMK Co., Ltd.--.

Signed and Sealed this

Twenty-second Day of October, 1991

*Attest:*

*Attesting Officer*

HARRY F. MANBECK, JR.

*Commissioner of Patents and Trademarks*